US007999763B2

(12) United States Patent
Han et al.

(10) Patent No.: US 7,999,763 B2
(45) Date of Patent: Aug. 16, 2011

(54) PLASMA DISPLAY APPARATUS

(75) Inventors: Jung Gwan Han, Gumi-si (KR); Bong Sup Jung, Busan-si (KR); Chi Yun Ok, Gumi-si (KR); Hyun Lark Do, Daegu-si (KR)

(73) Assignee: LG Electronics Inc., Seoul (KR)

( * ) Notice: Subject to any disclaimer, the term of this patent is extended or adjusted under 35 U.S.C. 154(b) by 706 days.

(21) Appl. No.: 11/622,707

(22) Filed: Jan. 12, 2007

(65) Prior Publication Data

US 2007/0164934 A1 Jul. 19, 2007

(30) Foreign Application Priority Data

Jan. 13, 2006 (KR) ..... 10-2006-0003815
Oct. 13, 2006 (KR) ..... 10-2006-0099853
Nov. 23, 2006 (KR) ..... 10-2006-0116619
Nov. 23, 2006 (KR) ..... 10-2006-0116620

(51) Int. Cl.
*G09G 3/28* (2006.01)

(52) U.S. Cl. ..... 345/60

(58) Field of Classification Search ..... 345/99, 345/60–63, 68–69
See application file for complete search history.

(56) References Cited

U.S. PATENT DOCUMENTS

2003/0169243 A1* 9/2003 Lee ..... 345/204
2003/0222591 A1* 12/2003 Kim et al. ..... 315/169.1
2004/0212564 A1* 10/2004 Lee et al. ..... 345/60
2006/0176246 A1* 8/2006 Shoji et al. ..... 345/60

FOREIGN PATENT DOCUMENTS

CN 1619613 A 5/2005
JP 2004-212699 A 7/2004
KR 10 2002-0025691 A 4/2002
KR 10 2004-0087116 A 10/2004
KR 10 2004-0107421 A 12/2004
KR 10 2005-0037639 A 4/2005
KR 1020060032632 4/2006

OTHER PUBLICATIONS

Chinese Office Action dated Jul. 11, 2008 for Application No. 200710002229.9, (English Translation), 10 pages.
Chinese Office Action dated Jul. 7, 2009 for Application No. 200710002229.9, (English Translation), 10 pages.

* cited by examiner

*Primary Examiner* — Chanh Nguyen
*Assistant Examiner* — Tsegaye Seyoum
(74) *Attorney, Agent, or Firm* — Fish & Richardson P.C.

(57) ABSTRACT

A plasma display apparatus is disclosed. In the plasma display apparatus, a data signal includes a voltage rising period during which the data signal gradually rises to a first voltage using an inductor, a voltage maintaining period during which the data signal is maintained at a second voltage higher than the first voltage, and a voltage falling period during which the data signal gradually falls to a voltage equal to or less than the second voltage. A magnitude of the first voltage is equal to or more than one half of a magnitude of the second voltage, and is less than the magnitude of the second voltage. A current flowing in the inductor ranges from zero ampere to a maximum current value of the inductor at a time when a voltage of the data signal is equal to the first voltage.

13 Claims, 16 Drawing Sheets

(a)

(b)

PLASMA DISPLAY APPARATUS

This Nonprovisional application claims priority under 35 U.S.C. §119(a) on Patent Application Nos. 10-2006-0099853 filed in Korea on Oct. 13, 2006, 10-2006-0116619 and 10-2006-0116620 filed in Korea on Nov. 23, 2006 and 10-2006-0003815 filed in Korea on Jan. 13, 2006 the entire contents of which are hereby incorporated by reference.

BACKGROUND

1. Field

This document relates to a plasma display apparatus.

2. Description of the Background Art

A plasma display apparatus includes a plasma display panel including a plurality of electrodes, and a driver supplying a predetermined driving signal to the electrodes of the plasma display panel.

The plasma display panel includes a phosphor layer inside a discharge cell partitioned by barrier ribs. The driver supplies the predetermined driving signal to the discharge cell through the electrodes.

When the driving signal generates the discharge inside the discharge cells, a discharge gas filled in the discharge cells generates ultraviolet rays, which thereby cause phosphors formed inside the discharge cells to emit light, thus displaying an image on the screen of the plasma display panel.

SUMMARY

In one aspect, a plasma display apparatus comprises a plasma display panel including an address electrode, and a driver supplying a data signal to the address electrode during an address period, wherein the data signal includes a voltage rising period during which the data signal gradually rises to a first voltage using an inductor, a voltage maintaining period during which the data signal is maintained at a second voltage higher than the first voltage, and a voltage falling period during which the data signal gradually falls to a voltage equal to or less than the second voltage, wherein a magnitude of the first voltage is equal to or more than one half of a magnitude of the second voltage, and is less than the magnitude of the second voltage, and wherein a current flowing in the inductor ranges from zero ampere to a maximum current value of the inductor at a time when a voltage of the data signal is equal to the first voltage.

In another aspect, a plasma display apparatus comprise a plasma display panel including an address electrode, and a driver supplying a data signal to the address electrode during an address period, wherein the data signal includes a voltage rising period during which the data signal gradually rises to a first voltage using an inductor, a voltage maintaining period during which the data signal is maintained at a second voltage higher than the first voltage, and a voltage falling period during which the data signal gradually falls to a voltage equal to or less than the second voltage, wherein a magnitude of the first voltage is equal to or more than one half of a magnitude of the second voltage, and is less than the magnitude of the second voltage, and wherein a current flowing in the inductor is more than zero ampere and is less than a maximum current value of the inductor at a time when a switch for supplying the second voltage is turned on.

In still another aspect, a plasma display apparatus comprises a plasma display panel including an address electrode, and a driver supplying a data signal to the address electrode during an address period, wherein the data signal includes a first data signal and a second data signal, wherein the first data signal and the second data signal each include a voltage rising period, a voltage maintaining period, and a voltage falling period, wherein when the first data signal and the second data signal are supplied consecutively, the first data signal falls to a third voltage higher than the lowest voltage supplied during the voltage rising period of the first data signal during the voltage falling period of the first data signal, and the second data signal gradually rises from the third voltage to a fourth voltage using an inductor during the voltage rising period of the second data signal.

BRIEF DESCRIPTION OF THE DRAWINGS

The accompany drawings, which are included to provide a further understanding of the invention and are incorporated on and constitute a part of this specification, illustrate embodiments of the invention and together with the description serve to explain the principles of the invention.

DETAILED DESCRIPTION OF PREFERRED EMBODIMENTS

Reference will now be made in detail embodiments of the invention examples of which are illustrated in the accompanying drawings.

Figure 1:
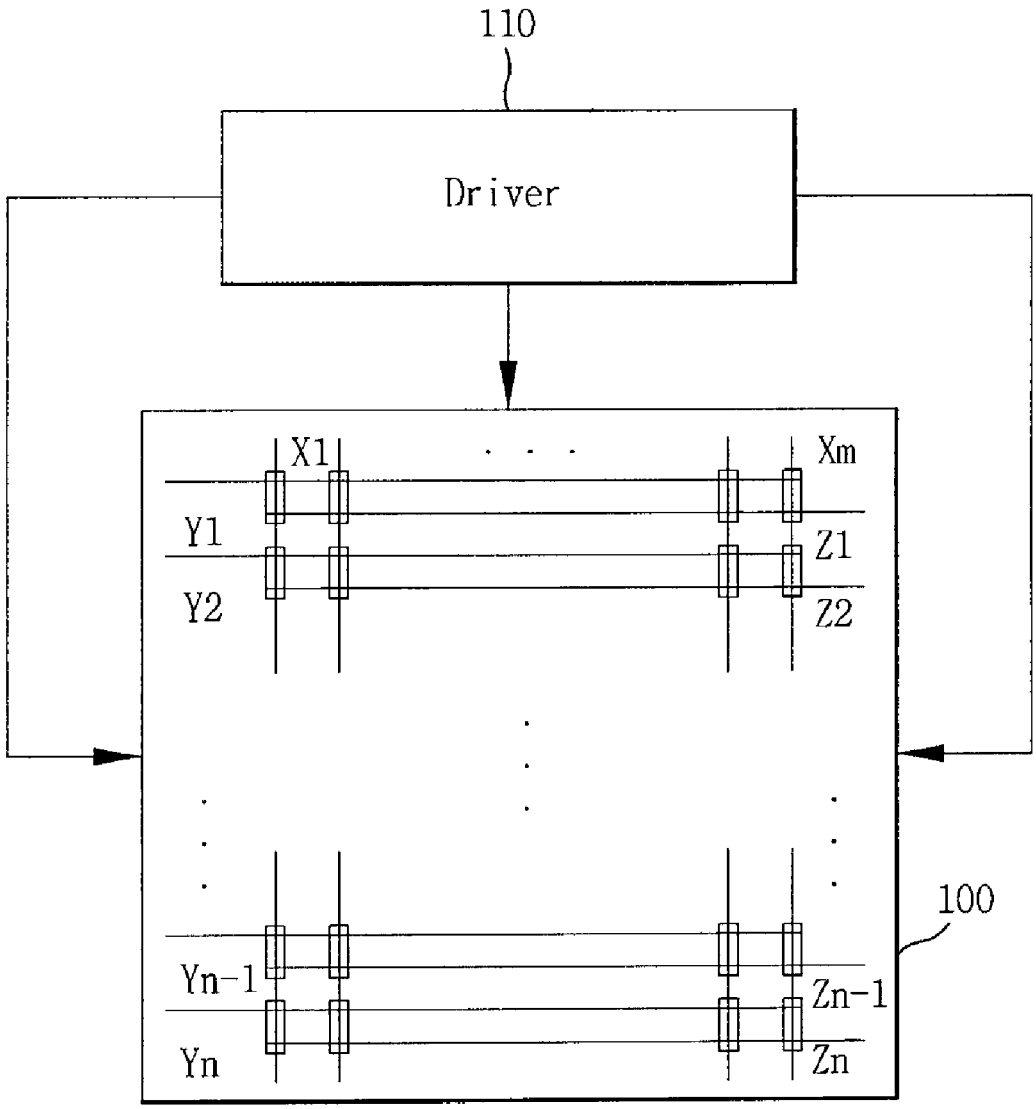
FIG. 1 illustrates a configuration of a plasma display apparatus according to one embodiment.

FIG. 1 illustrates a configuration of a plasma display apparatus according to one embodiment.

Referring to FIG. 1, the plasma display apparatus according to one embodiment includes a plasma display panel 100 and a driver 110.

The plasma display panel 100 includes scan electrodes Y1-Yn and sustain electrodes Z1-Zn positioned in parallel, and address electrodes X1-Xm intersecting the scan electrodes Y1-Yn and the sustain electrodes Z1-Zn.

The driver 110 supplies a data signal to the address electrodes X1-Xm during an address period of one subfield.

Although FIG. 1 has illustrated a case where the driver 110 is formed in the form of a signal board, the driver 110 may be formed in the form of a plurality of boards depending on the electrodes formed in the plasma display panel 100.

For example, the driver 110 may include a first driver for driving the scan electrodes Y1-Yn, a second driver for driving the sustain electrodes Z1-Zn, and a third driver for driving the address electrodes X1-Xm.

Figure 2:
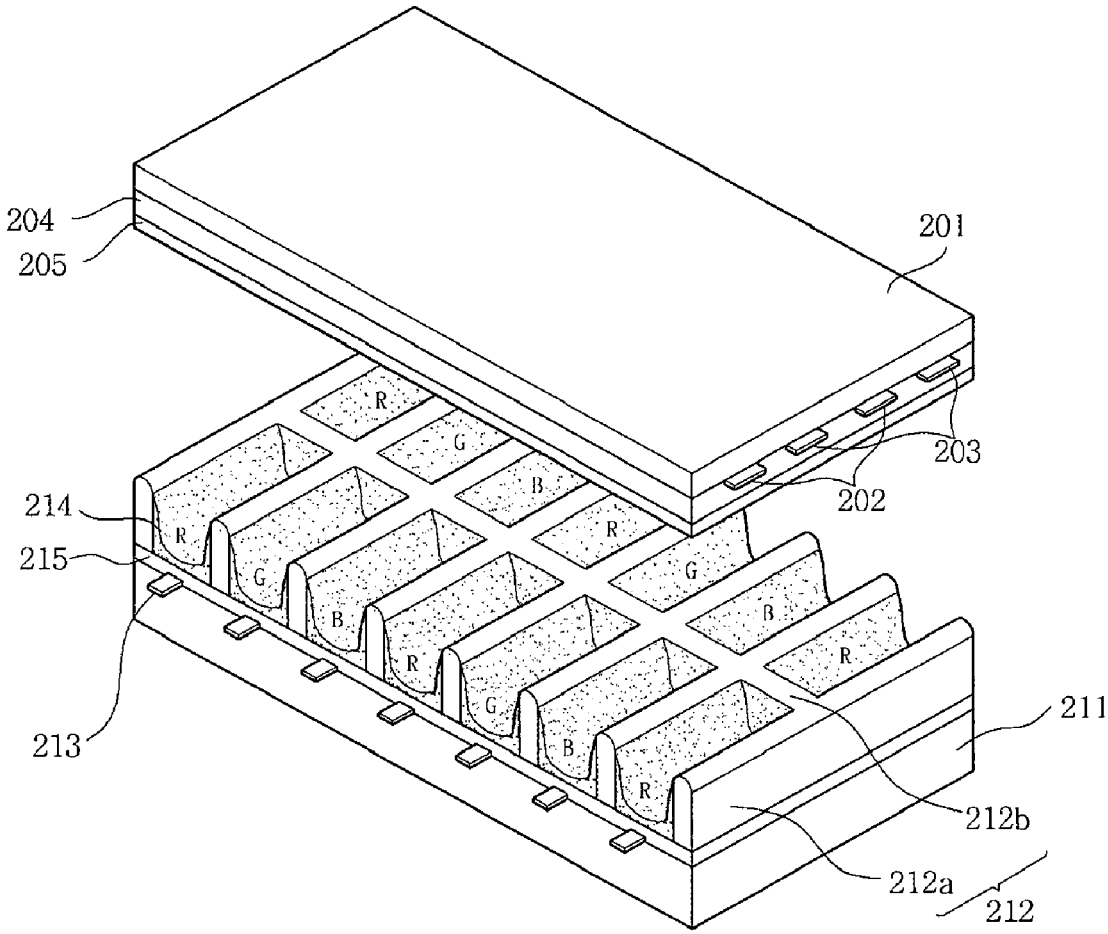
FIG. 2 illustrates a structure of a plasma display panel of the plasma display apparatus according to one embodiment.

FIG. 2 illustrates a structure of a plasma display panel of the plasma display apparatus according to one embodiment.

Referring to FIG. 2, the plasma display panel according to one embodiment includes a front substrate 201 and a rear substrate 211 which are coalesced with each other. On the front substrate 201, a scan electrode 202 and a sustain electrode 203 are formed in parallel to each other. On the rear substrate 211, an address electrode 213 is formed to intersect the scan electrode 202 and the sustain electrode 203.

The upper dielectric layer 204 for covering the scan electrode 202 and the sustain electrode 203 is formed on an upper portion of the front substrate 201 on which the scan electrode 202 and the sustain electrode 203 are formed.

The upper dielectric layer 204 limits discharge currents of the scan electrode 202 and the sustain electrode 203, and provides insulation between the scan electrode 202 and the sustain electrode 203.

A protective layer 205 is formed on an upper surface of the upper dielectric layer 204 to facilitate discharge conditions. The protective layer 205 includes a material having a high secondary electron emission coefficient, for example, magnesium oxide (MgO).

A lower dielectric layer 215 for covering the address electrode 213 is formed on an upper portion of the rear substrate 211 on which the address electrode 213 is formed. The lower dielectric layer 215 provides insulation of the address electrode 213.

Barrier ribs 212 of a stripe type, a well type, a delta type, a honeycomb type, and the like, are formed on an upper portion of the lower dielectric layer 215 to partition discharge spaces (i.e., discharge cells). A red (R) discharge cell, a green (G) discharge cell, and a blue (B) discharge cell, and the like, are formed between the front substrate 201 and the rear substrate 211.

In addition to the red (R), green (G), and blue (B) discharge cells, a white (W) discharge cell or a yellow (Y) discharge cell may be further formed between the front substrate 201 and the rear substrate 211.

The widths of the red (R), green (G), and blue (B) discharge cells may be substantially equal to one another. Further, the width of at least one of the red (R), green (G), or blue (B) discharge cells may be different from the widths of the other discharge cells.

For instance, the width of the red (R) discharge cell may be the smallest, and the widths of the green (G) and blue (B) discharge cells may be more than the width of the red (R) discharge cell. The width of the green (G) discharge cell may be substantially equal to or different from the width of the blue (B) discharge cell.

The widths of the above-described discharge cells determine the width of a phosphor layer 214 formed inside the discharge cells, which will be described later. For example, the width of a blue (B) phosphor layer formed inside the blue (B) discharge cell may be more than the width of a red (R) phosphor layer formed inside the red (R) discharge cell. Further, the width of a green (G) phosphor layer formed inside the green (G) discharge cell may be more than the width of the red (R) phosphor layer formed inside the red (R) discharge cell. As a result, a color temperature of an image displayed on the plasma display panel is improved.

The plasma display panel according one embodiment may have various forms of barrier rib structures as well as a structure of the barrier rib 212 illustrated in FIG. 2. For instance, the barrier rib 212 includes a first barrier rib 212*b* and a second barrier rib 212*a*. The barrier rib 212 may have a differential type barrier rib structure in which the height of the first barrier rib 212*b* and the height of the second barrier rib 212*a* are different from each other, a channel type barrier rib structure in which a channel usable as an exhaust path is formed on at least one of the first barrier rib 212*b* or the second barrier rib 212*a*, a hollow type barrier rib structure in which a hollow is formed on at least one of the first barrier rib 212*b* or the second barrier rib 212*a*, and the like.

In the differential type barrier rib structure, the height of the first barrier rib 212*b* may be less than the height of the second barrier rib 212*a*. Further, in the channel type barrier rib structure, a channel may be formed on the first barrier rib 212*b*.

While the plasma display panel according to one embodiment has been illustrated and described to have the red (R), green (G), and blue (B) discharge cells arranged on the same line, it is possible to arrange them in a different pattern. For instance, a delta type arrangement in which the red (R), green (G), and blue (B) discharge cells are arranged in a triangle shape may be applicable. Further, the discharge cells may have a variety of polygonal shapes such as pentagonal and hexagonal shapes as well as a rectangular shape.

While FIG. 2 has illustrated and described a case where the barrier rib 212 is formed on the rear substrate 211, the barrier rib 212 may be formed on at least one of the front substrate 201 or the rear substrate 211.

Each of the discharge cells partitioned by the barrier ribs 212 is filled with a predetermined discharge gas.

The phosphor layer 214 for emitting visible light for an image display when generating an address discharge is formed inside the discharge cells partitioned by the barrier ribs 212. For instance, red (R), green (G) and blue (B) phosphor layers may be formed inside the discharge cells.

A white (W) phosphor layer and/or a yellow (Y) phosphor layer may be further formed in addition to the red (R), green (G) and blue (B) phosphor layers.

The thickness of at least one of the phosphor layers 214 formed inside the red (R), green (G) and blue (B) discharge cells may be different from the thicknesses of the other phosphor layers. For instance, the thicknesses of green (G) and blue (B) phosphor layers inside the green (G) and blue (B) discharge cells may be more than the thickness of a red (R) phosphor layer inside the red (R) discharge cell. The thickness of the green (G) phosphor layer inside the green (G) discharge cell may be substantially equal to or different from the thickness of the blue (B) phosphor layer inside the blue (B) discharge cell.

It should be noted that only one example of the plasma display panel according to one embodiment has been illustrated and described above, and the present embodiment is not limited to the plasma display panel of the above-described structure. For instance, while, the above description illustrates a case where the upper dielectric layer 204 and the lower dielectric layer 215 each are formed in the form of a single layer, at least one of the upper dielectric layer 204 and the lower dielectric layer 215 may be formed in the form of a plurality of layers.

A black layer (not illustrated) for absorbing external light may be further formed on the upper portion of the barrier rib 212 to prevent the reflection of the external light caused by the barrier rib 212.

Further, another black layer (not illustrated) may be further formed at a specific position of the front substrate 201 corresponding to the barrier rib 212.

The address electrode 213 formed on the rear substrate 211 may have a substantially constant width or thickness. Further, the width or thickness of the address electrode 213 inside the discharge cell may be different from the width or thickness of the address electrode 213 outside the discharge cell. For instance, the width or thickness of the address electrode 213 inside the discharge cell may be more than the width or thickness of the address electrode 213 outside the discharge cell.

Figure 3:
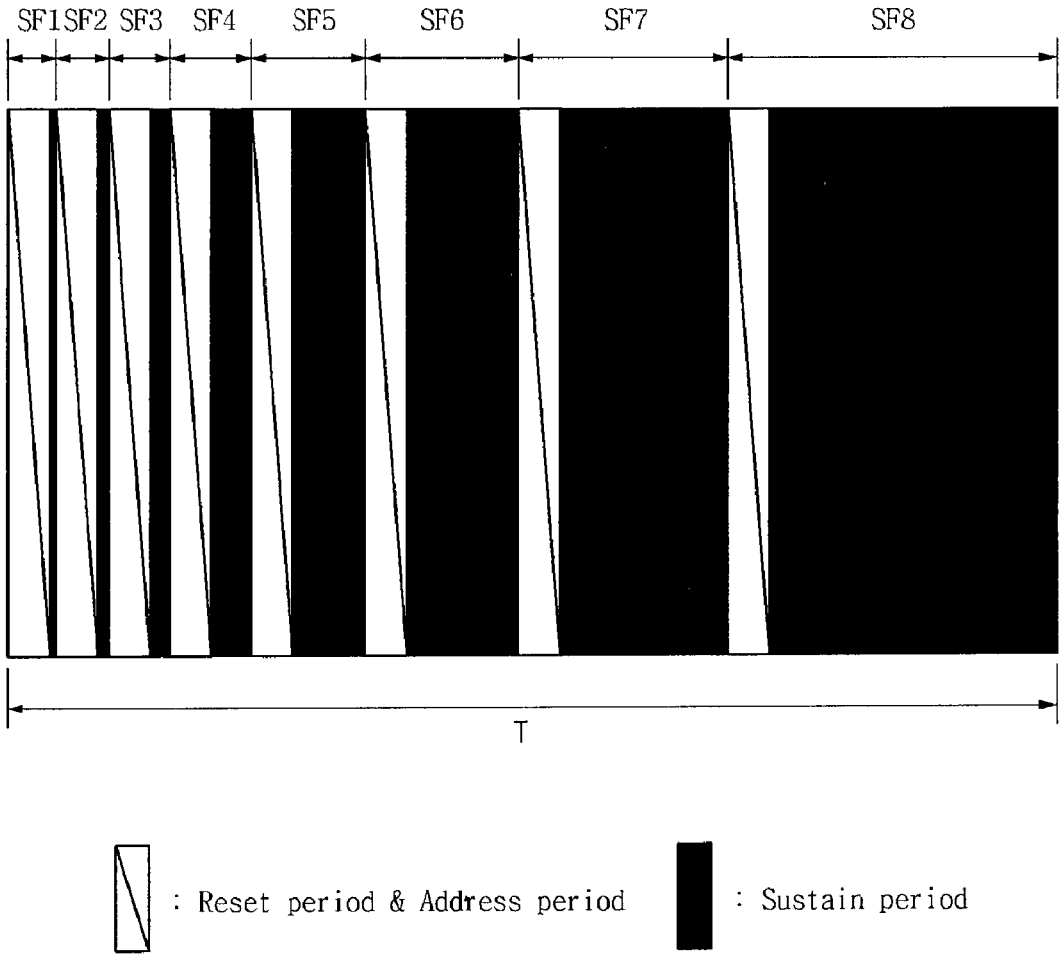
FIG. 3 illustrates a frame for achieving a gray level of an image displayed by the plasma display apparatus according to one embodiment.

FIG. 3 illustrates a frame for achieving a gray level of an image displayed by the plasma display apparatus according to one embodiment.

Referring to FIG. 3, a frame for achieving a gray level of an image displayed by the plasma display apparatus according to one embodiment is divided into several subfields each having a different number of emission times.

Each subfield is subdivided into a reset period for initializing all the cells, an address period for selecting cells to be discharged, and a sustain period for representing gray level in accordance with the number of discharges.

For example, if an image with 256-level gray level is to be displayed, a frame, as illustrated in FIG. 3, is divided into 8 subfields SF1 to SF8. Each of the 8 subfields SF1 to SF8 is subdivided into a reset period, an address period, and a sustain period.

The number of sustain signals supplied during the sustain period determines gray level weight in each of the subfields. For example, in such a method of setting gray level weight of a first subfield to $2^0$ and gray level weight of a second subfield to $2^1$, the sustain period increases in a ratio of $2^n$ (where, n=0, 1, 2, 3, 4, 5, 6, 7) in each of the subfields. Since the sustain period varies from one subfield to the next subfield, a specific gray level is achieved by controlling the sustain period which are to be used for discharging each of the selected cells, i.e., the number of sustain discharges that are realized in each of the discharge cells.

The plasma display panel according to one embodiment uses a plurality of frames to display an image during 1 second. For example, 60 frames are used to display an image during 1 second. In this case, a duration T of time of one frame may be 1/60 seconds, i.e., 16.67 ms.

Although FIG. 3 has illustrated and described a case where one frame includes 8 subfields, the number of subfields constituting one frame may vary. For example, one frame may include 12 subfields or 10 subfields.

Further, although FIG. 3 has illustrated and described the subfields arranged in increasing order of gray level weight, the subfields may be arranged in decreasing order of gray level weight, or the subfields may be arranged regardless of gray level weight.

Figure 4:
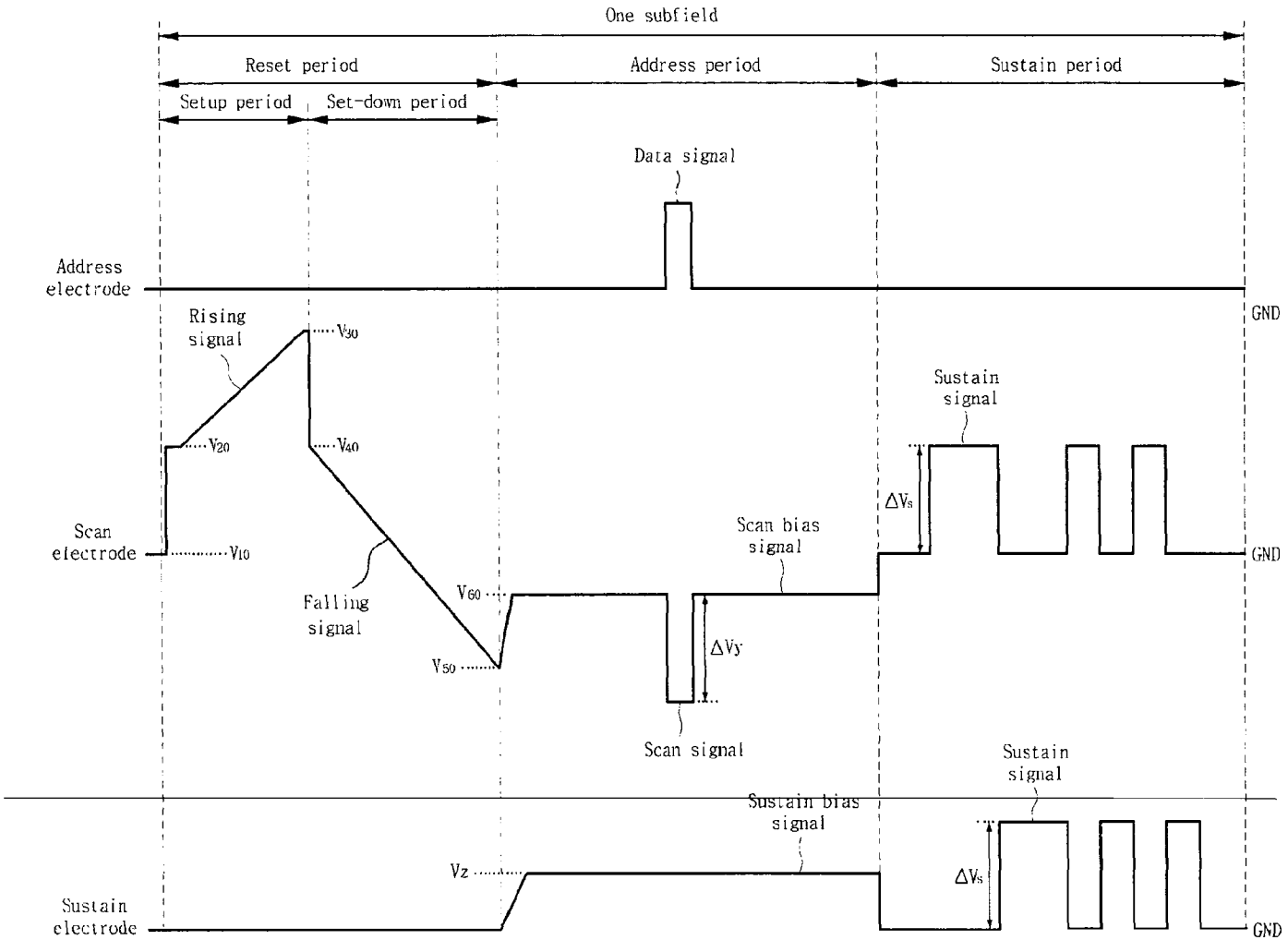
FIG. 4 illustrates one example of an operation of the plasma display apparatus according to one embodiment during one subfield of a frame.

FIG. 4 illustrates one example of an operation of the plasma display apparatus according to one embodiment during one subfield of a frame. The driver 110 of FIG. 1 supplies driving signals which will be described below.

Figure 5A:
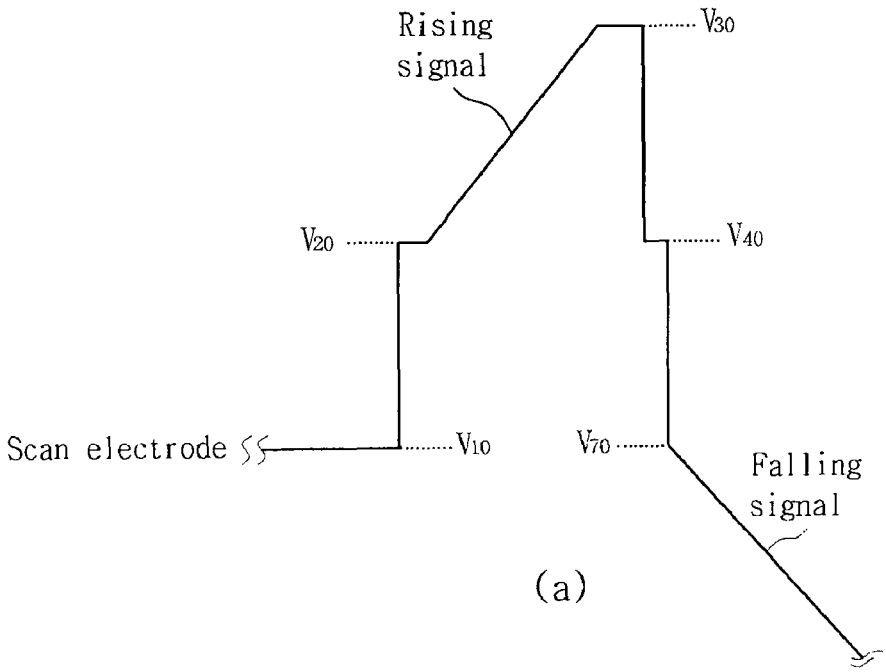
FIGS. 5*a* to 5*c* illustrate another operation of the plasma display apparatus according to one embodiment.
Figure 5A:
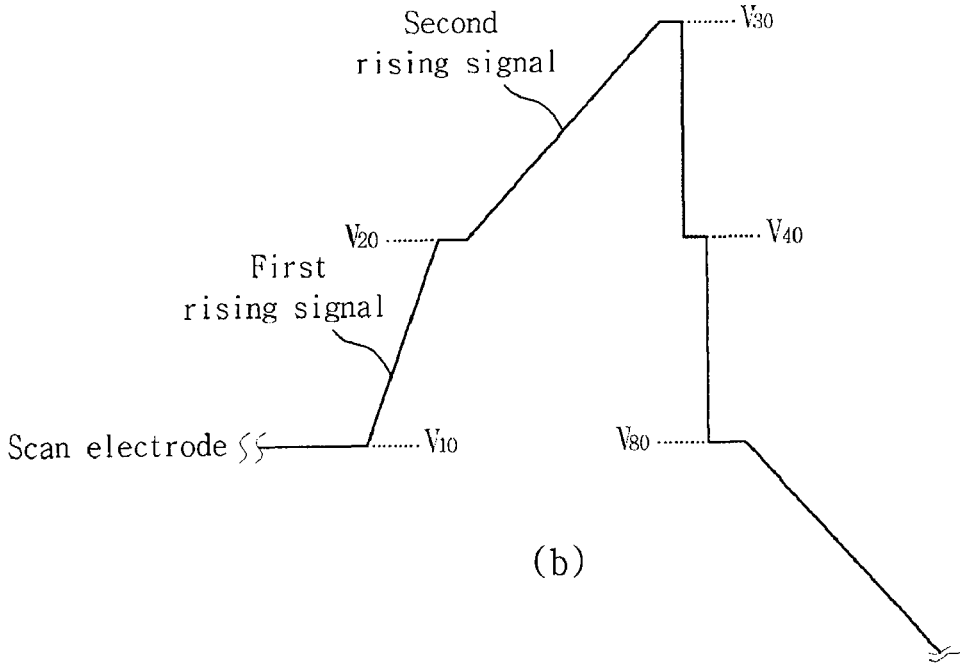
Figure 5B:
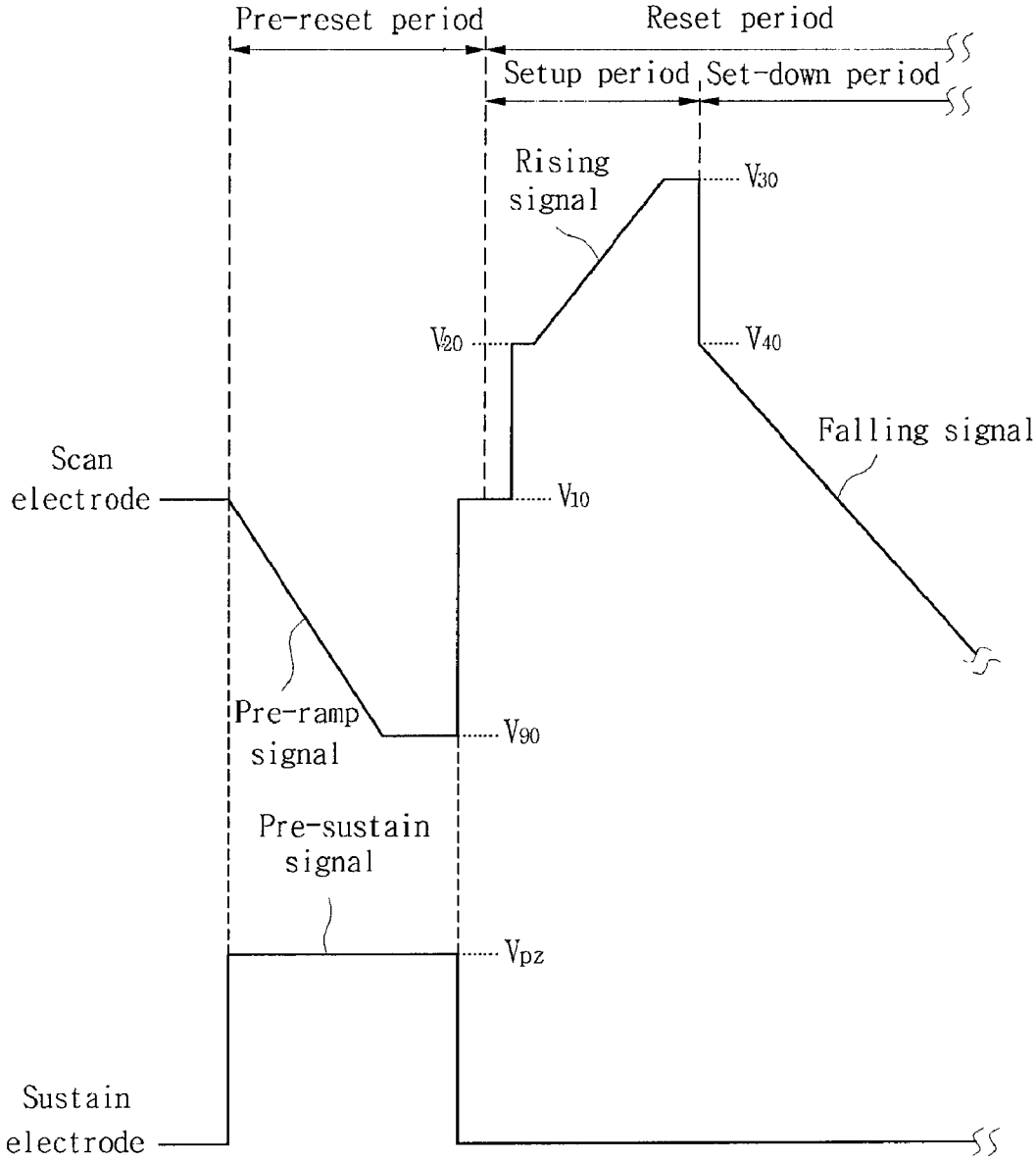
Figure 5C:
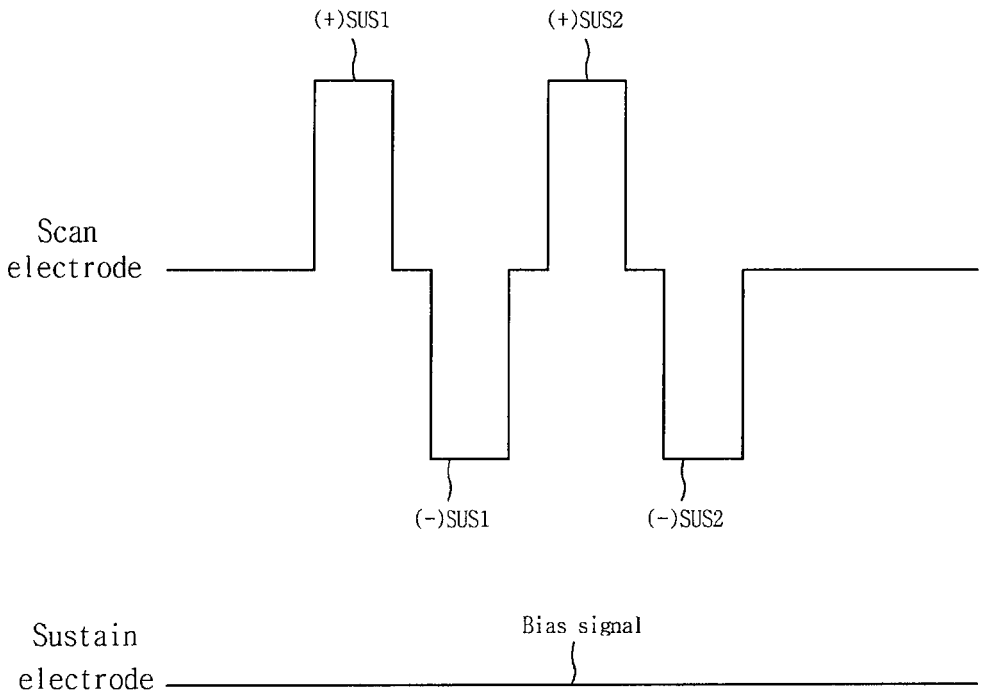

FIGS. 5*a* to 5*c* illustrate another operation of the plasma display apparatus according to one embodiment.

Referring to FIG. 4, a reset period is further divided into a setup period and a set-down period. During the setup period, a rising signal is supplied to the scan electrode. The rising signal sharply rises from a tenth voltage V10 to a twentieth voltage V20, and then gradually rises from the twentieth voltage V20 to a thirtieth voltage V30. The tenth voltage V10 is equal to a ground level voltage GND.

The rising signal generates a weak dark discharge (i.e., a setup discharge) inside a discharge cell during the setup period, thereby accumulating a proper amount of wall charges inside the discharge cell.

During the set-down period, a falling signal of a polarity direction opposite a polarity direction of the rising signal is supplied to the scan electrode.

The falling signal gradually falls from a fortieth voltage V40, that is lower than the highest voltage (i.e., the thirtieth voltage V30) of the rising signal, to a fiftieth voltage V50.

The falling signal generates a weak erase discharge (i.e., a set-down discharge) inside the discharge cell. Furthermore, the remaining wall charges are uniform inside the discharge cells to the extent that an address discharge can be stably performed.

The rising signal and the falling signal may be changed in various forms.

As illustrated in (a) of FIG. 5*a*, a falling signal gradually falls from a seventieth voltage V70, that is lower than the fortieth voltage V40. In other words, a voltage of the scan electrode may be changed at a supply start time point of the falling signal. The seventieth voltage V70 may be substantially equal to the tenth voltage V10.

As illustrated in (b) of FIG. 5*a*, a rising signal includes a first rising signal and a second rising signal each having a different rising slope.

The first rising signal gradually rises from the tenth voltage V10 to the twentieth voltage V20 with a first slope. The second rising signal gradually rises from the twentieth voltage V20 to the thirtieth voltage V30 with a second slope.

When the second slope is gentler than the first slope, the voltage of the rising signal rises relatively rapidly until the setup discharge occurs, and the voltage of the rising signal rises relatively slowly during the generation of the setup discharge. As a result, the quantity of light generated by the setup discharge is reduced. Accordingly, contrast of the plasma display apparatus is improved.

An eightieth voltage V80 illustrated in (b) of FIG. 5*a* may be substantially equal to the seventieth voltage V70 (a) of FIG. 5*a*.

The subfield may include a pre-reset period prior to the reset period. As illustrated in FIG. 5*b*, the subfield further includes a pre-reset period prior to the reset period. During the pre-reset period, a pre-ramp signal gradually falling to a ninetieth voltage V90 is supplied to the scan electrode.

During the supplying of the pre-ramp signal to the scan electrode, a pre-sustain signal of a polarity direction opposite a polarity direction of the pre-ramp signal is supplied to the sustain electrode.

The pre-sustain signal is constantly maintained at a pre-sustain voltage Vpz. The pre-sustain voltage Vpz may be substantially equal to a voltage (i.e., a sustain voltage Vs) of a sustain signal which will be supplied during a sustain period.

As above, during the pre-reset period, the pre-ramp signal is supplied to the scan electrode and the pre-sustain signal is supplied to the sustain electrode. As a result, wall charges of a predetermined polarity are accumulated on the scan electrode, and wall charges of a polarity opposite the polarity of the wall charges accumulated on the scan electrode are accumulated on the sustain electrode. For example, wall charges of a positive polarity are accumulated on the scan electrode, and wall charges of a negative polarity are accumulated on the sustain electrode.

As a result, a setup discharge with a sufficient strength occurs during the reset period such that the initialization of all the discharge cells is performed stably.

Furthermore, although a voltage of a rising signal supplied to the scan electrode during the reset period is low, a setup discharge with a sufficient strength occurs.

A subfield, which is first arranged in time order in a plurality of subfields of one frame, may include a pre-reset period prior to a reset period so as to obtain sufficient driving time. Or, two or three subfields may include a pre-reset period prior to a reset period.

All the subfields may not include the pre-reset period.

Referring again to FIG. 4, during an address period, a scan bias signal, which is maintained at a sixtieth voltage V60 higher than the lowest voltage V50 of the falling signal, is supplied to the scan electrode.

A scan signal, which falls from the scan bias signal by a scan voltage magnitude ΔVy, is supplied to the scan electrode.

The width of the scan signal may vary from one subfield to the next subfield. In other words, the width of a scan signal in at least one subfield may be different from the width of a scan signal in the other subfields. For example, the width of a scan signal in a subfield may be more than the width of a scan signal in the next subfield in time order. Further, the width of the scan signal may be gradually reduced in the order of 2.6 μs, 2.3 μs, 2.1 μs, 1.9 μs, etc., or in the order of 2.6 μs, 2.3 μs, 2.3 μs, 2.1 μs, 1.9 μs, 1.9 μs, etc.

As above, when the scan signal is supplied to the scan electrode, a data signal corresponding to the scan signal is supplied to the address electrode.

As the voltage difference between the scan signal and the data signal is added to the wall voltage generated during the reset period, the address discharge is generated within the discharge cell to which the data signal is supplied.

A sustain bias signal is supplied to the sustain electrode during the address period to prevent the generation of the unstable address discharge caused by interference of the sustain electrode.

The sustain bias signal is substantially maintained at a sustain bias voltage Vz. The sustain bias voltage Vz is lower than the sustain voltage Vs, and is higher than the ground level voltage GND.

During the sustain period, a sustain signal is alternately supplied to the scan electrode and the sustain electrode.

As the wall voltage within the discharge cell selected by performing the address discharge is added to the sustain voltage Vs of the sustain signal, every time the sustain signal is supplied, the sustain discharge, i.e., a display discharge occurs between the scan electrode and the sustain electrode.

The sustain signal may be changed in various forms. As illustrated in FIG. 5*c*, a sustain signal ((+)SUS1, (+)SUS2) of a positive polarity direction and a sustain signal ((−)SUS1, (−)SUS2) of a negative polarity direction are alternately supplied to either the scan electrode or the sustain electrode, for example, to the scan electrode in FIG. 5*c*.

As above, when the sustain signal of the positive polarity direction and the sustain signal of the negative polarity direction are alternately supplied to the scan electrode, a bias signal is supplied to the sustain electrode. The bias signal is constantly maintained at the ground level voltage GND.

As illustrated in FIG. 5*c*, when the sustain signal is supplied to either the scan electrode or the sustain electrode, a single diving board for installing a circuit for supplying the sustain signal to either the scan electrode or the sustain electrode is required. Accordingly, the whole size of a driver for driving the plasma display panel is reduced such that the manufacturing cost is reduced.

Figure 6:
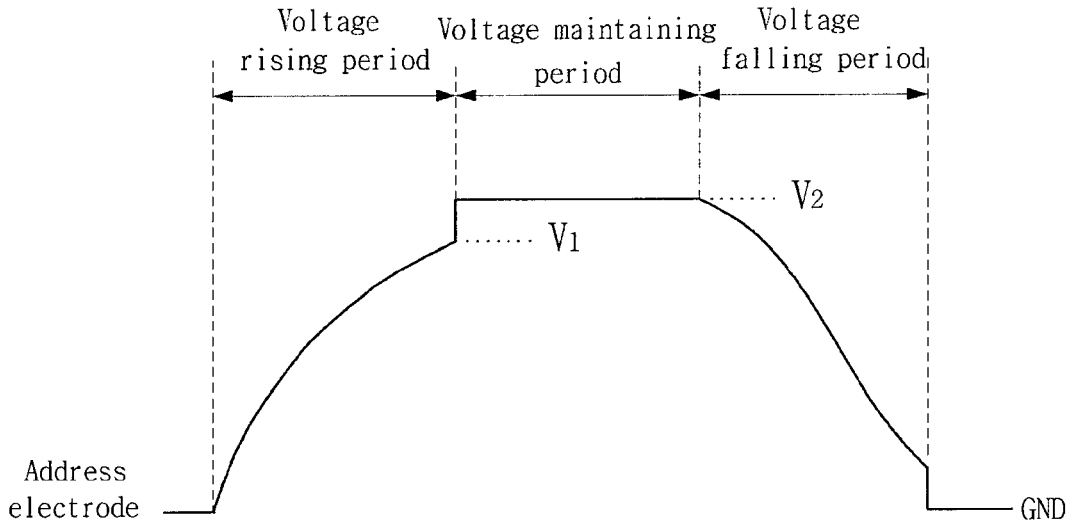
FIG. 6 illustrates a data signal.

FIG. 6 illustrates a data signal.

Referring to FIG. 6, the data signal supplied to the address electrode during the address period includes a voltage rising period, a voltage maintaining period, and a voltage falling period.

During the voltage rising period, the data signal gradually rises to a first voltage V1 using an inductor. During the voltage maintaining period, the data signal is maintained at a second voltage V2 that is higher than the first voltage V1. During the voltage falling period, the data signal gradually falls to a voltage equal to or less than the second voltage V2.

Figure 7:
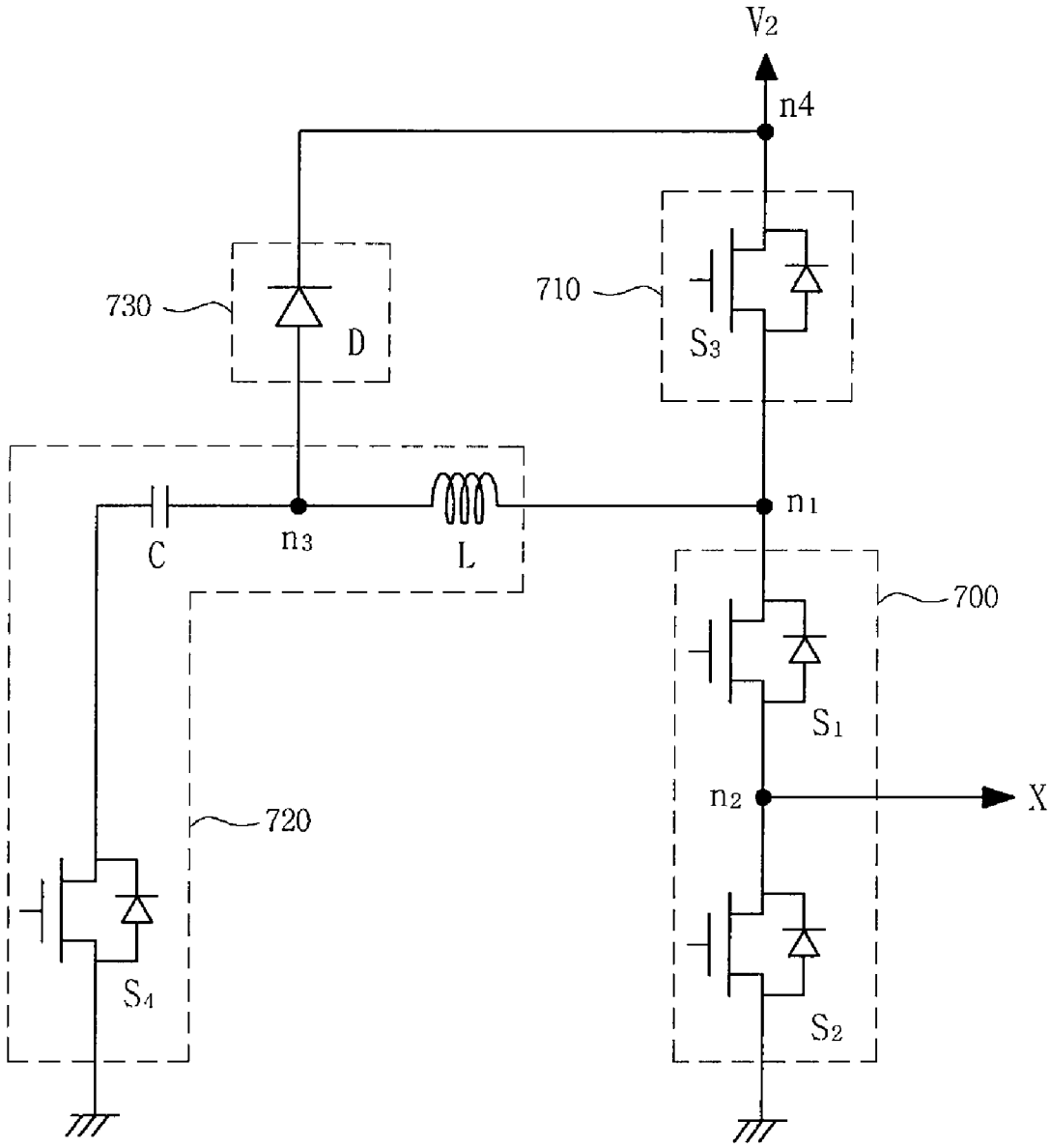
FIG. 7 illustrates one example of a configuration of a driver for supplying a data signal.

FIG. 7 illustrates one example of a configuration of a driver for supplying a data signal. FIGS. 8*a* to 8*f* illustrate one example of an operation of the driver of FIG. 7.

Referring to FIG. 7, a driver includes a data drive integrated circuit (IC) 700, a data voltage supply unit 710, and an energy recovery unit 720.

The data voltage supply unit 710 includes a third switch S3 for supplying the second voltage V2. The third switch S3 operates to supply the second voltage V2 output from a data voltage source (not illustrated) to the data drive IC 700.

The data drive IC 700 is connected to the address electrode X. A voltage supplied to the data drive IC 700 is supplied to the address electrode X through a predetermined switching operation of the data drive IC 700. An output voltage of the data voltage supply unit 710, an output voltage of the energy recovery unit 720, and the ground level voltage GND are selectively supplied to the address electrode X.

The data drive IC 700 includes a first switch S1 and a second switch S2. One terminal of the first switch S1 is commonly connected to the data voltage supply unit 710 and the energy recovery unit 720, and the other terminal is connected to one terminal of the second switch S2. The other terminal of the second switch S2 is grounded. A second node n2 between the other terminal of the first switch S1 and one terminal of the second switch S2 is connected to the address electrode X.

The data drive IC 700 may be formed in one module independent of the data voltage supply unit 710 and the energy recovery unit 720. The data drive IC 700 may be formed in the form of one chip on a flexible substrate, for example, a tape carrier package (TCP).

The energy recovery unit 720 includes a capacitor C, an inductor L, and a fourth switch S4. The capacitor C, the inductor L, and the fourth switch S4 are connected in parallel.

The capacitor C stores an energy supplied to the address electrode X, and stores a reactive energy recovered from the address electrode X.

The fourth switch S4 forms a supply path of the energy supplied from the capacitor C to the address electrode X. The fourth switch S4 forms a recovery path of the energy recovered from the address electrode X to the capacitor C.

The inductor L and the plasma display panel form LC resonance such that the energy stored in the capacitor C is supplied to the address electrode X and the reactive energy of the address electrode X is stored in the capacitor C.

One terminal of the fourth switch S4 is connected to the other terminal of the capacitor C, and the other terminal is grounded. One terminal of the capacitor C is connected to the other terminal of the inductor L. One terminal of the inductor L is commonly connected to the data voltage supply unit 710 and the first switch S1 of the data drive IC 700 at a first node n1.

The driver further includes a current cutout unit 730. The current cutout unit 730 includes a diode D for preventing a current flowing between the capacitor C of the energy recovery unit 720 and a data voltage source (not illustrated). The current cutout unit 730 prevents the second voltage V2 output from the data voltage source from flowing into the capacitor C.

Figure 8A:
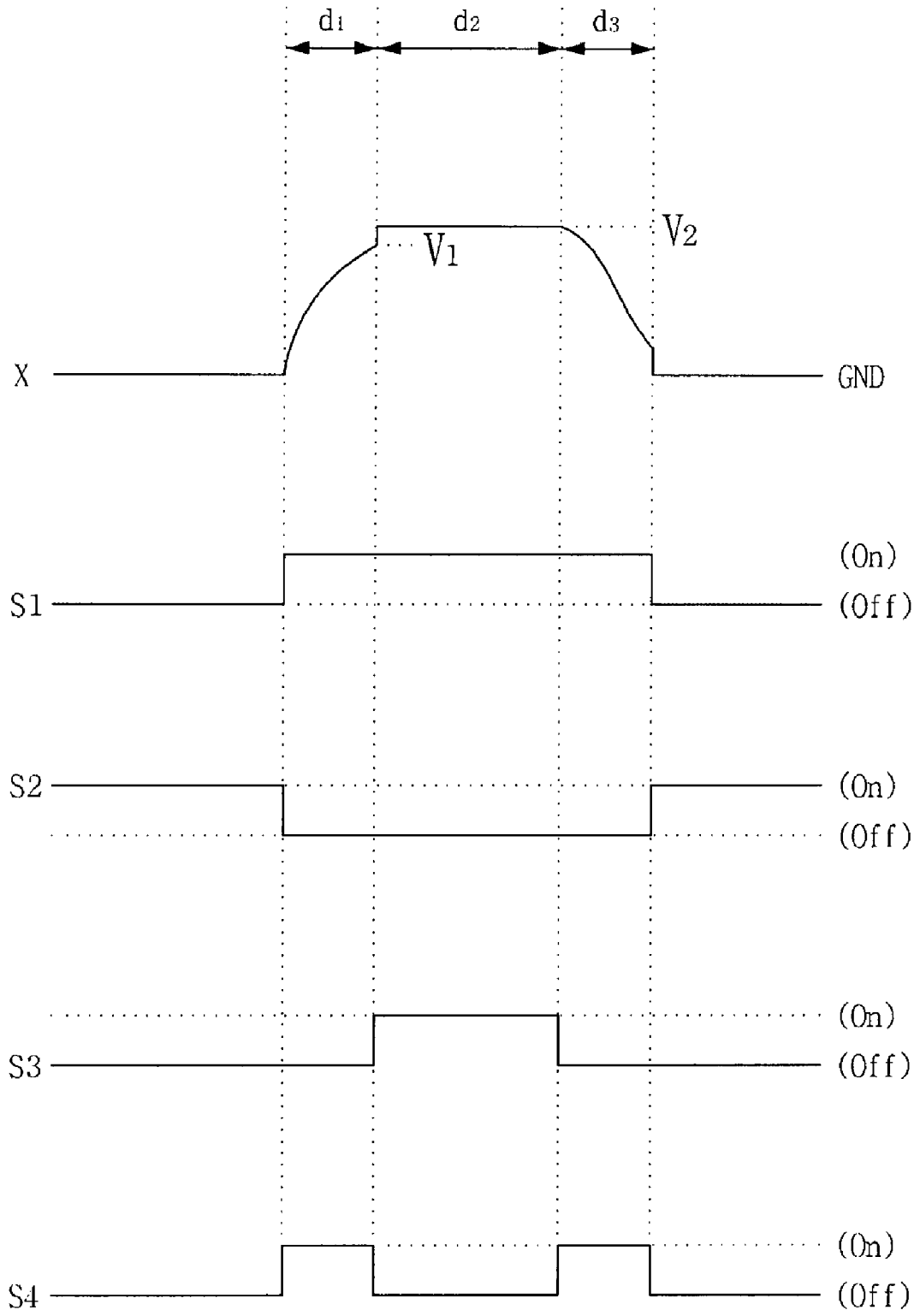
FIGS. 8*a* to 8*f* illustrate one example of an operation of the driver of FIG. 7.

FIG. 8*a* illustrates switching timing of the driver of FIG. 7 for supplying a data signal including a voltage rising period, a voltage maintaining period, and a voltage falling period to the address electrode X.

During a voltage rising period d1, the fourth switch S4 of the energy recovery unit 720 and the first switch S1 of the data drive IC 700 are turned on. The third switch S3 of the data voltage supply unit 710 and the second switch S2 of the data drive IC 700 are turned off.

Figure 8B:
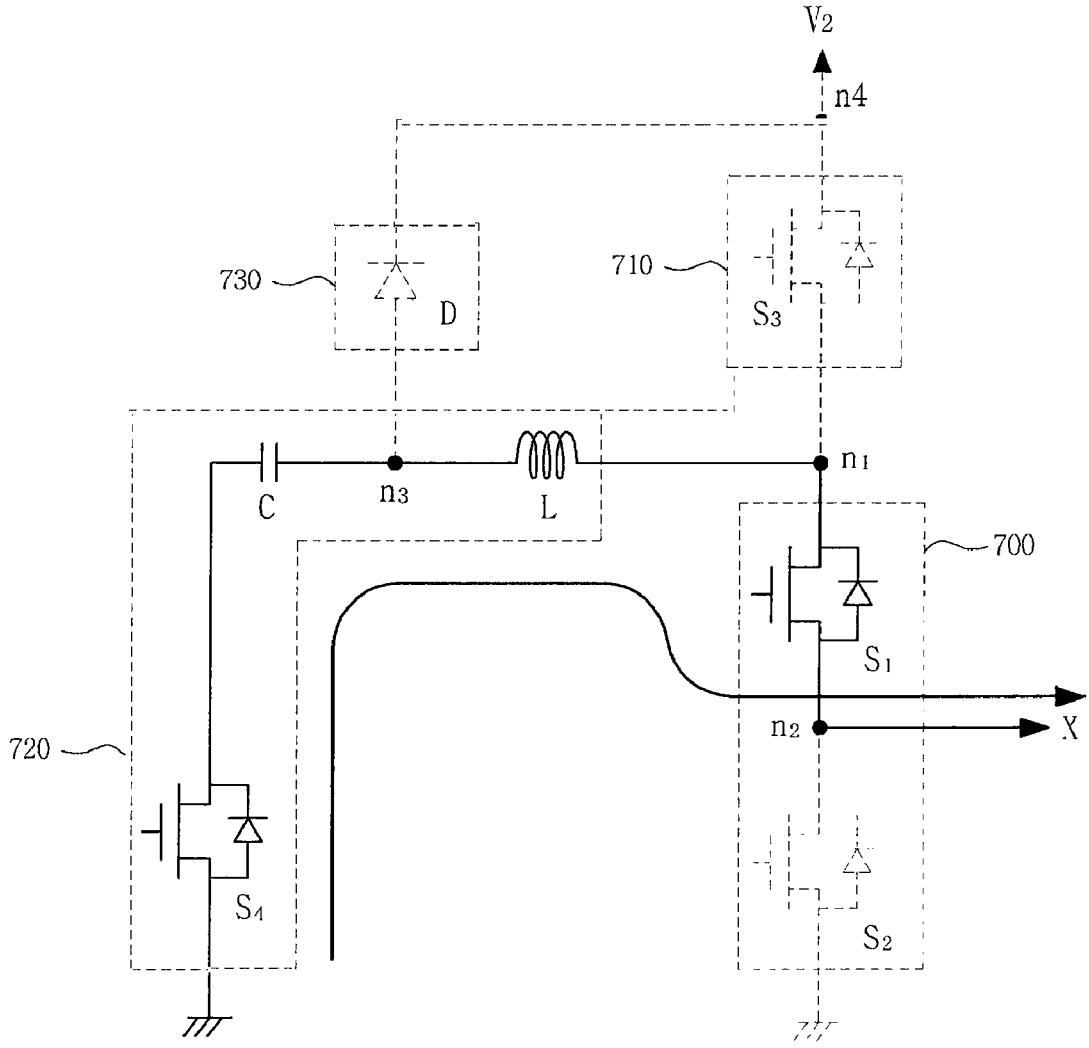

As illustrated in FIG. 8*b*, the energy stored in the capacitor C of the energy recovery unit 720 is supplied to the address electrode X through a third node n3, the inductor L, the first node n1, and the first switch S1.

The inductor L and the plasma display panel form LC resonance such that a voltage of the address electrode X gradually rises to the first voltage V1.

During a voltage maintaining period d2, the third switch S3 of the data voltage supply unit 710 and the first switch S1 of the data drive IC 700 are turned on. The fourth switch S4 of the energy recovery unit 720 and the second switch S2 of the data drive IC 700 are turned off.

Figure 8C:
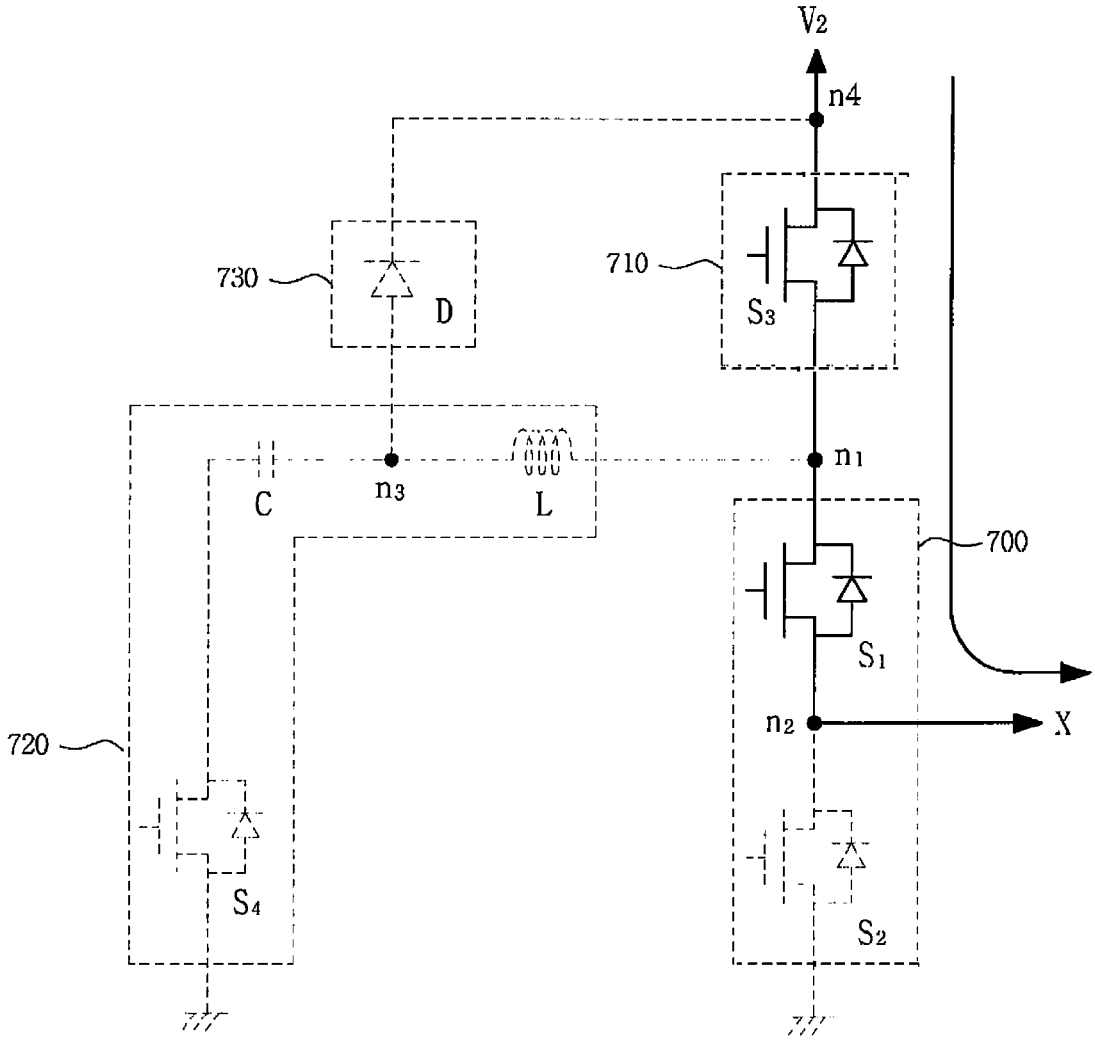

As illustrated in FIG. 8*c*, the second voltage V2 supplied from the data voltage source is supplied to the address electrode X through the third switch S3 of the data voltage supply unit 710, the first node n1, and the first switch S1 of the data drive IC 700. Accordingly, the voltage of the address electrode X (i.e., the voltage of the data signal) rises from the first voltage V1 to the second voltage V2. In other words, the voltage of the data signal is clamped to the second voltage V2 at a time when the voltage of the data signal is equal to the first voltage V1.

In a case where the voltage of the data signal (i.e., the first voltage V1) is excessively low at an end of the voltage rising period d1, maintaining time of the resonance generated by the inductor L is excessively reduced. As a result, the energy stored in the capacitor C is not sufficiently supplied to the address electrode X such that the driving efficiency is reduced.

On the other hand, in a case where the first voltage V1 is excessively high, maintaining time of the resonance generated by the inductor L increases excessively. As a result, that the unstable address discharge may occurs due to the fluctuation of the voltage of the data signal.

Considering this, a magnitude of the first voltage V1 may be equal to or more than one half of a magnitude of the second voltage V2 (i.e., the voltage of the data signal during the voltage maintaining period d2), and may be less than the magnitude of the second voltage V2. Further, the magnitude of the first voltage V1 may range from 0.6 to 0.85 times the magnitude of the second voltage V2.

In a case where the length of the voltage rising period d1 is excessively long, the length of one data signal excessively lengthens such that total driving time may be insufficient. Further, in a case where the length of the voltage rising period d1 is excessively short, the maintaining time of the resonance generated by the inductor L is excessively reduced. As a result, the energy stored in the capacitor C is not sufficiently supplied to the address electrode X such that the driving efficiency is reduced.

To prevent the reduction in the driving efficiency and the unstable address discharge, a length of the voltage rising period d1 may range from 0.05 to 0.4 times or from 0.08 to 0.35 times a sum of lengths of the voltage rising period d1, the voltage maintaining period d2, and the voltage falling period d3.

Figure 8D:
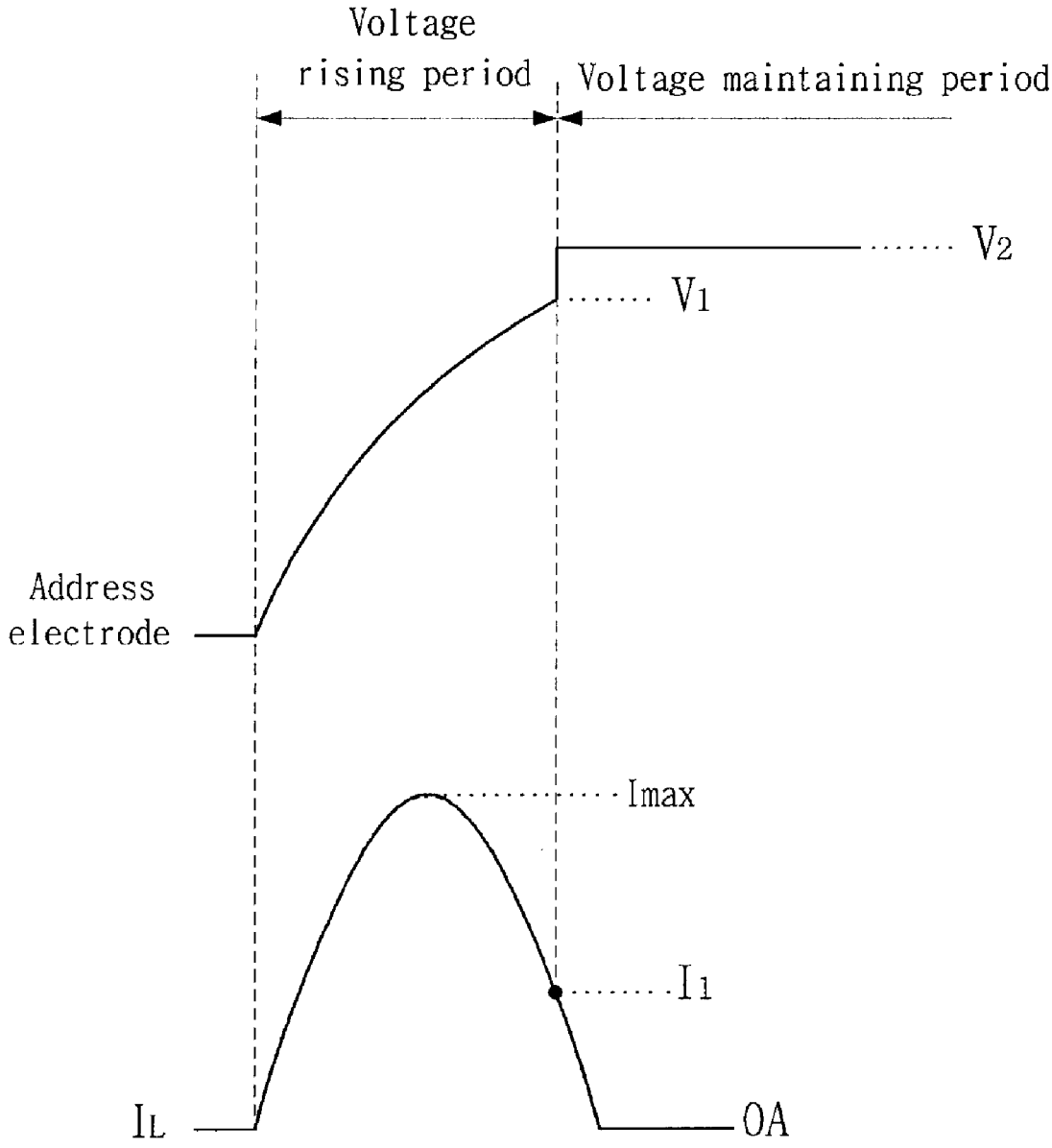

FIG. 8*d* illustrates a current $I_L$ flowing in the inductor L during the voltage rising period d1 and the voltage maintaining period d2.

Referring to FIG. 8*d*, a current flows from the inductor L into the address electrode X during the voltage rising period d1, and the amount of current increases.

The current $I_L$ flowing in the inductor L ranges from zero ampere to a maximum current value Imax of the inductor L at the time when the voltage of the data signal is equal to the first voltage V1. More specifically, the current $I_L$ flowing in the inductor L ranges from 0.2 to 0.7 times a maximum current Imax flowing in the inductor L during the voltage rising period d1 at the time when the voltage of the data signal is equal to the first voltage V1.

The time when the voltage of the data signal is equal to the first voltage V1 is substantially equal to a time when the third switch S3 for supplying the second voltage V2 is turned on in a case of FIG. 8*c*.

During the voltage falling period d3, the fourth switch S4 of the energy recovery unit 720 and the first switch S1 of the data drive IC 700 are turned on. The third switch S3 of the data voltage supply unit 710 and the second switch S2 of the data drive IC 700 are turned off.

Figure 8E:
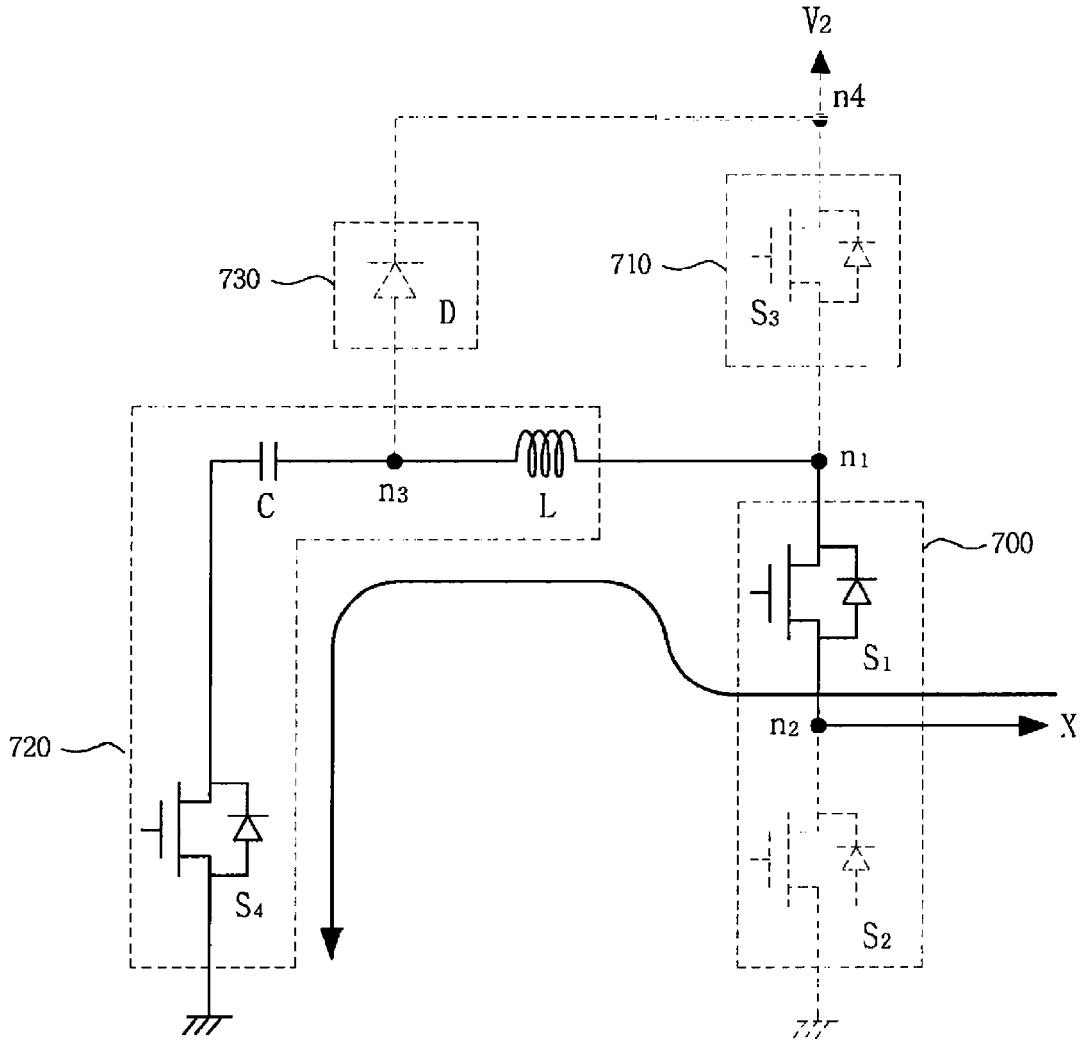

Accordingly, as illustrated in FIG. 8*e*, the reactive energy of the address electrode X is stored in the capacitor C through the first switch S1 of the data drive IC 700, the first ode n1, and the inductor L.

The inductor L and the plasma display panel form LC resonance such that the voltage of the data signal gradually falls to a voltage equal to or less than the second voltage V2.

After the voltage falling period d3, the second switch S2 of the data drive IC 700 is turned on. The third switch S3 of the data voltage supply unit 710, the fourth switch S4 of the energy recovery unit 720, and the first switch S1 of the data drive IC 700 are turned off.

Figure 8F:
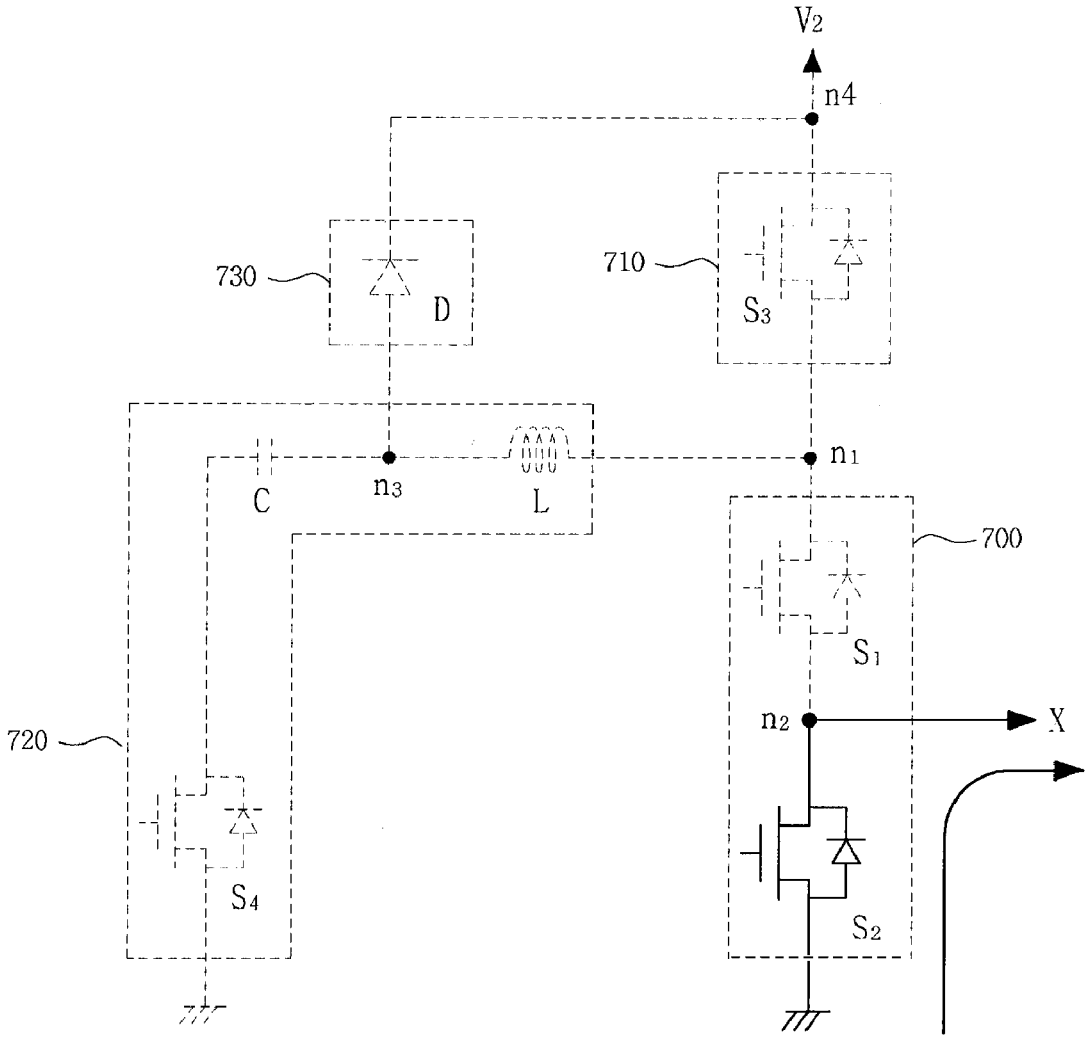

Accordingly, as illustrated in FIG. 8*f*, the ground level voltage GND is supplied to the address electrode X through the second switch S2 of the data drive IC 700.

The data signal is supplied to the address electrode X through the above-described processes.

Figure 9:
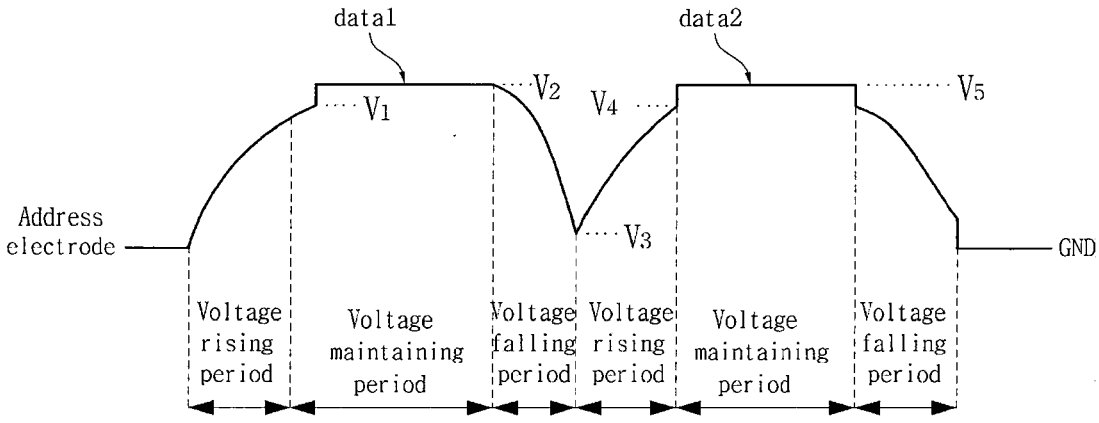
FIG. 9 illustrates a case where two data signals are supplied consecutively.

FIG. 9 illustrates a case where two data signals are supplied consecutively.

As illustrated in FIG. 9, it is assumed that the data signal includes a first data signal (data 1) and a second data signal (data 2).

The first data signal (data 1) and the second data signal (data 2) each include a voltage rising period, a voltage maintaining period, and a voltage falling period.

When the first data signal (data 1) and the second data signal (data 2) are supplied consecutively, the first data signal (data 1) falls to a third voltage V3 higher than the lowest voltage (for example, the ground level voltage GND) supplied during the voltage rising period of the first data signal (data 1) during the voltage falling period of the first data signal (data 1). Further, the second data signal (data 2) gradually rises from the third voltage V3 to a fourth voltage V4 using the inductor during the voltage rising period of the second data signal (data 2).

More specifically, the first data signal (data 1) gradually rises to the first voltage V1 using the inductor during the voltage rising period, is maintained at the second voltage V2 higher than the first voltage V1 during the voltage maintaining period, and gradually falls to the third voltage V3 lower than the second voltage V2 during the voltage falling period.

Further, the second data signal (data 2) gradually rises from the third voltage V3 to the fourth voltage V4 using the inductor during the voltage rising period, is maintained at a fifth voltage V5 higher than the fourth voltage V4 during the voltage maintaining period, and gradually falls to a voltage equal to or less than the fifth voltage V5 during the voltage falling period. The second voltage V2 may be equal to the fifth voltage V5, and the first voltage V1 may be equal to the fourth voltage V4.

Figure 10:
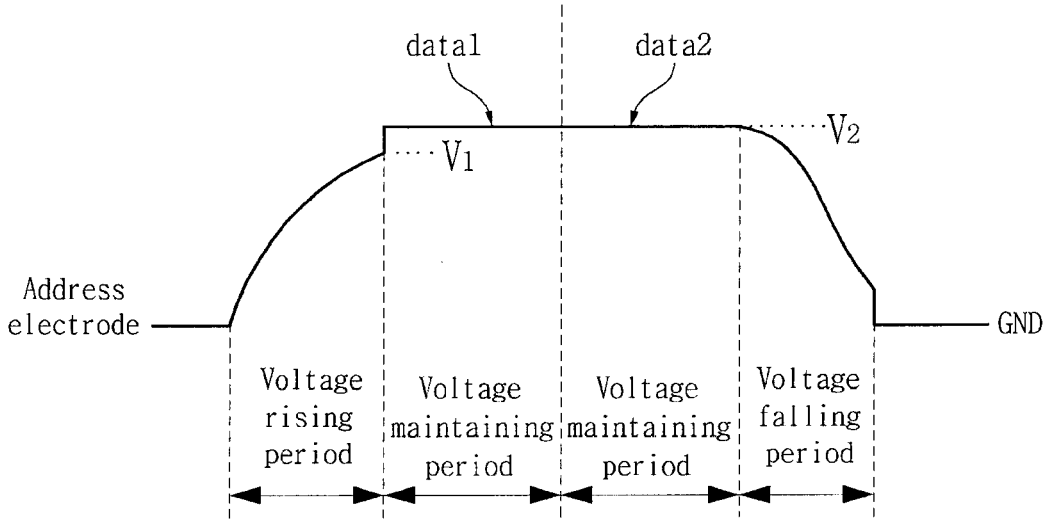
FIG. 10 illustrates a reason why two data signals are consecutively supplied on condition of FIG. 9.

FIG. 10 illustrates a reason why two data signals are consecutively supplied on condition of FIG. 9.

As illustrated n FIG. 10, when the first data signal (data 1) and the second data signal (data 2) are supplied consecutively, the voltage falling period of the first data signal (data 1) and the voltage rising period of the second data signal (data 2) are omitted and the voltage maintaining period of the first data signal (data 1) and the voltage maintaining period of the second data signal (data 2) are disposed consecutively. As a result, one energy recovery operation of FIG. 8*d* performed during the voltage falling period of the first data signal (data 1) is omitted such that the energy recovery efficiency is reduced and the driving efficiency is reduced.

In a case where three or more data signals are supplied consecutively, the number of omitted energy recovery operations further increases. Therefore, the driving efficiency is further reduced.

On the other hand, when the first data signal (data 1) and the second data signal (data 2) are consecutively supplied as illustrated in FIG. 9, the energy recovery operation of FIG. 8*d* and the energy supply operation of FIG. 8*b* are performed consecutively.

In other words, when the first data signal (data 1) and the second data signal (data 2) are supplied consecutively, the energy recovery operation of FIG. 8*d* is performed prior to the voltage falling period of the first data signal (data 1). Therefore, a reduction in the energy recovery efficiency is prevented such that the driving efficiency is sufficiently secured.

In a case where the first data signal (data 1) and the second data signal (data 2) are supplied consecutively and the magnitude of the third voltage V3 is excessively high, the length of the voltage falling period of the first data signal (data 1) shortens excessively. Accordingly, the energy recovery efficiency is reduced.

On the other hand, in a case where the first data signal (data 1) and the second data signal (data 2) are supplied consecutively and the magnitude of the third voltage V3 is excessively low, time required to sufficiently raise the voltage of the second data signal (data 2) subsequent to the supplying of the first data signal (data 1) increase excessively. Accordingly, the energy recovery efficiency is reduced and driving time is not sufficient.

considering this, the magnitude of the third voltage V3 may range from 0.1 to 0.7 times the magnitude of the second voltage V2. Further, the magnitude of the third voltage V3 may range from 0.25 to 0.45 times the magnitude of the second voltage V2.

Figure 11:
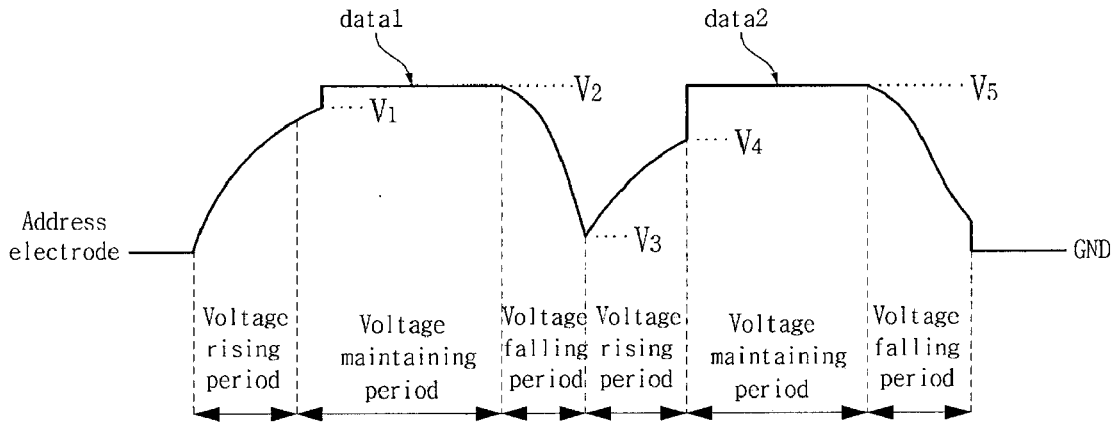
FIG. 11 illustrates another case where a first data signal and a second data signal are supplied consecutively.

FIG. 11 illustrates another case where a first data signal and a second data signal are supplied consecutively.

Although a case where the first voltage V1 of the first data signal (data 1) and the fourth voltage V4 of the second data signal (data 2) are equal to each other has been described above, the first voltage V1 may be different from the fourth voltage V4 as illustrated in FIG. 11.

More specifically, when the energy recovery operation during the voltage falling period of the first data signal (data 1) and the energy supply operation during the voltage rising period of the second data signal (data 2) are performed consecutively, the fourth voltage V4 is less than the first voltage V1. As a result, time required to sufficiently raise the voltage of the second data signal (data 2) subsequent to the supplying of the first data signal (data 1) is reduced.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures. Moreover, unless the term "means" is explicitly recited in a limitation of the claims, such limitation is not intended to be interpreted under 35 USC 112(6).

What is claimed is:

1. A plasma display apparatus, comprising:

a plasma display panel including an address electrode; and a driver configured to supply a data signal to the address electrode during an address period, wherein the data signal includes a voltage rising period during which the data signal gradually rises from a ground level voltage to a first voltage using an inductor, a voltage maintaining period during which the data signal is maintained at a second voltage higher than the first voltage, and a voltage falling period during which the data signal gradually falls to a voltage less than the second voltage, wherein a magnitude of the first voltage is more than the ground level voltage, the magnitude of the first voltage is equal to or more than one half of a magnitude of the second voltage, and the magnitude of the first voltage is less than the magnitude of the second voltage, wherein, at a time when the voltage of the data signal is equal to the first voltage, a voltage of the data signal is clamped to the second voltage and a current flowing in the inductor ranges from 0.2 to 0.7 times a maximum current value of the inductor, wherein the data signal includes a first data signal and a second data signal, the second data signal being supplied consecutively after the first data signal, wherein, during a voltage falling period of the first data signal, the first data signal falls to a third voltage higher than a lowest voltage supplied during a voltage rising period of the first data signal, and wherein the second data signal gradually rises from the third voltage to a fourth voltage using the inductor period of the second data signal, the fourth voltage being lower than the first voltage.

2. The plasma display apparatus of claim 1, wherein the magnitude of the first voltage ranges from 0.6 to 0.85 times the magnitude of the second voltage.

3. The plasma display apparatus of claim 1, wherein a length of the voltage rising period ranges from 0.05 to 0.4 times a sum of lengths of the voltage rising period, the voltage maintaining period, and the voltage falling period.

4. The plasma display apparatus of claim 3, wherein the length of the voltage rising period ranges from 0.08 to 0.35 times the sum of the lengths of the voltage rising period, the voltage maintaining period, and the voltage falling period.

5. The plasma display apparatus of claim 1, wherein a magnitude of the third voltage ranges from 0.1 to 0.7 times the magnitude of the second voltage.

6. The plasma display apparatus of claim 1, wherein the magnitude of the third voltage ranges from 0.25 to 0.45 times the magnitude of the second voltage.

7. A plasma display apparatus, comprising:

a plasma display panel including an address electrode; and a driver configured to supply a data signal to the address electrode during an address period, wherein the data signal includes a voltage rising period during which the data signal gradually rises from a ground level voltage to a first voltage using an inductor, a voltage maintaining period during which the data signal is maintained at a second voltage higher than the first voltage, and a voltage falling period during which the data signal gradually falls to a voltage less than the second voltage, wherein a magnitude of the first voltage is more than the ground level voltage, the magnitude of the first voltage is equal to or more than one half of a magnitude of the second voltage, and the magnitude of the first voltage is less than the magnitude of the second voltage, wherein a voltage of the data signal is clamped to the second voltage and a current flowing in the inductor ranges from 0.2 to 0.7 times a maximum current value of the inductor at a time when a switch for supplying the second voltage is turned on, wherein the data signal includes a first data signal and a second data signal, the second data signal being supplied consecutively after the first data signal, wherein, during a voltage falling period of the first data signal, the first data signal falls to a third voltage higher than a lowest voltage supplied during a voltage rising period of the first data signal, and wherein the second data signal gradually rises from the third voltage to a fourth voltage using the inductor during period of the second data signal, the fourth voltage being lower than the first voltage.

8. The plasma display apparatus of claim 7, wherein the magnitude of the first voltage ranges from 0.6 to 0.85 times the magnitude of the second voltage.

9. The plasma display apparatus of claim 7, wherein a length of the voltage rising period ranges from 0.05 to 0.4 times a sum of lengths of the voltage rising period, the voltage maintaining period, and the voltage falling period.

10. The plasma display apparatus of claim 9, wherein the length of the voltage rising period ranges from 0.08 to 0.35 times the sum of the lengths of the voltage rising period, the voltage maintaining period, and the voltage falling period.

11. A plasma display apparatus, comprising:

a plasma display panel including an address electrode; and a driver configured to supply a data signal to the address electrode during an address period, wherein the data signal includes a first data signal and a second data signal, wherein the second data signal is supplied consecutively after the first data signal, wherein the first data signal includes a voltage rising period during which the first data signal gradually rises from a ground level voltage to a first voltage using an inductor, a voltage maintaining period during which the first data signal is maintained at a second voltage higher than the first voltage, and a voltage falling period during which the first data signal gradually falls to a third voltage higher than a lowest voltage supplied during the voltage rising period of the first data signal and during the voltage falling period of the first data signal, wherein the second data signal includes a voltage rising period during which the second data signal gradually rises from the third voltage to a fourth voltage using an inductor, a voltage maintaining period during which the second data signal is maintained at a fifth voltage higher than the third voltage, and a voltage falling period during which the second data signal gradually falls to a voltage higher than the ground level voltage, the fourth voltage being lower than the first voltage, wherein a voltage of the data signal is clamped to the second voltage at a time when the voltage of the data signal is equal to the first voltage, and wherein the driver includes an inductor and wherein a current flowing in the inductor ranges from 0.2 to 0.7 times a maximum current value of the inductor at a time when a voltage of the first data signal is equal to the first voltage.

12. The plasma display apparatus of claim 11, wherein a magnitude of the third voltage ranges from 0.1 to 0.7 times a magnitude of the second voltage.

13. The plasma display apparatus of claim 12, wherein the magnitude of the third voltage ranges from 0.25 to 0.45 times the magnitude of the second voltage.

* * * * *